US006234120B1

(12) United States Patent
Karlsson

(10) Patent No.: US 6,234,120 B1
(45) Date of Patent: May 22, 2001

(54) TWO-STROKE ENGINE

(76) Inventor: Hans Karlsson, Vintervagen 17, S-177 60 Jarfalla (SE)

( * ) Notice: Subject to any disclaimer, the term of this patent is extended or adjusted under 35 U.S.C. 154(b) by 0 days.

(21) Appl. No.: 09/529,859

(22) PCT Filed: Oct. 20, 1998

(86) PCT No.: PCT/SE98/01883

§ 371 Date: Apr. 18, 2000

§ 102(e) Date: Apr. 18, 2000

(87) PCT Pub. No.: WO99/20878

PCT Pub. Date: Apr. 29, 1999

(30) Foreign Application Priority Data

Oct. 20, 1997 (SE) ..... 9703820

(51) Int. Cl.[7] ..... F02B 25/08

(52) U.S. Cl. ..... 123/51 BA; 123/51 BD; 123/73 A

(58) Field of Search ..... 123/51 B, 51 BA, 123/51 BD, 559.1, 73 A, 73 V, 69 R, 73 S, 65 BA, 65 A

(56) References Cited

U.S. PATENT DOCUMENTS

Re. 20,254 * 1/1937 Robertson ..... 123/51 BA
871,539 * 11/1907 Van Auken ..... 123/51 BA
1,339,187 * 5/1920 Fite et al. ..... 123/51 BA
2,844,131 7/1958 Beveridge .
2,853,983 9/1958 Sawle, Jr. .
4,071,000 1/1978 Herbert .
4,216,747 8/1980 Noguchi et al. .
4,840,164 * 6/1989 Parsons ..... 123/559.1

* cited by examiner

*Primary Examiner*—Noah P. Kamen
(74) *Attorney, Agent, or Firm*—Fasth Law Offices; Rolf Fasth

(57) ABSTRACT

The two-stroke internal combustion engine has a cylinder, a piston, a connecting rod connected between a crankshaft and the piston. The engine has an inlet defined at a crankcase for conveying a fuel mixture from a carburetor. The engine includes a cylinder which has two pistons that move towards and away from each other. The engine includes crankcases at both ends of the cylinder so that each crankcase accommodates a crankshaft which is connected to the pistons via piston rods. The crankshafts are interconnected mechanically so that both pistons move simultaneously towards their top and bottom center positions. The carburetor is connected to the first crankcase. Only the second crankcase is connected to the induction port via a passage. The pipe extends between the first crankcase and the second crankcase for conveying the fuel mixture from the first crankcase to the second crankcase.

9 Claims, 4 Drawing Sheets

TWO-STROKE ENGINE

TECHNICAL FIELD

The present invention relates to a two-stroke engine.

BACKGROUND AND SUMMARY OF THE INVENTION

Two-stroke engines have many advantages over four-stroke engines. One distinct advantage is that two-stroke engines have far fewer movable parts than four-stroke engines. Another advantage is that the fuel is combusted each time the piston reaches the top of the cylinder, i.e. a working stroke takes place with each revolution of the piston, via the crankshaft coupled to the piston rod.

One drawback of two-stroke engines is that the combustion of the fuel mixture is poor due to the fact that fresh fuel mixture is delivered to the cylinder at the same time as the exhaust gases are ventilated. This results in non-combusted fuel mixture departing with the exhaust gases.

The most common type of two-stroke engines includes passages for conveying the fuel mixture into the cylinder space in the cylinder wall at a distance from the cylinder combustion chamber that slightly exceeds the distance from the combustion chamber to an exhaust port in the cylinder wall. When fuel is combusted in the combustion chamber, the piston moves downwardly and the upper surface of the piston will thus first pass the exhaust port so that the exhaust gases flow out the port. The upper surface of the piston will then pass the passageways through which fuel mixture flows into the cylinder. However, this inflow of fuel mixture takes place while the exhaust port is still open. As the piston moves upwardly, it will first pass the passageways that are closed and thereafter pass the exhaust port so as to close the same. A certain portion of the fuel mixture will be pressed out through the exhaust port, partly while fuel mixture is being injected into the cylinder and partly during the upward movement of the piston.

This problem may be avoided by directly injecting fuel through the cylinder head of the engine, and by injecting air into the cylinder, via a valve mounted in the cylinder head, subsequent to the exhaust port having been closed by the piston as it moves up in the cylinder. However, this solution requires providing the engine with electronic means for controlling the injection nozzle and also with a compressor for delivering the combustion air.

The present invention solves the problem of achieving a high degree of combustion in two-stroke engines without requiring additional movable parts or other control equipment for delivering a fuel mixture. The two-stroke internal combustion engine of the present invention includes a cylinder, a piston, a connecting rod connected between a crankshaft and the piston, a crankcase inlet for fuel mixture from a carburetor, a passageway defined between the crankcase an induction or inlet port in the cylinder wall, and an exhaust port in said cylinder wall. The exhaust port communicates with the surroundings so that a cylinder is common to two oppositely moving pistons. Crankcases are provided at both ends of the cylinder so that each crankcase includes a crankshaft which is connected to respective pistons via a piston rod and so that the crankshafts are interconnected mechanically. In this way, both pistons may move simultaneously to their top center positions and also move simultaneously to their bottom center-positions. A carburetor is connected to the first crankcase. An important feature is that only the second crankcase is connected to the induction port via a passageway. The exhaust port is positioned for coaction with the piston belonging to the first crankcase. A pipe extends between the first crankcase and the second crankcase for transporting the fuel mixture from the first crankcase to the second crankcase. A check valve is provided between the first crankcase and the inlet end of the pipe.

DETAILED DESCRIPTION

Figure 1:
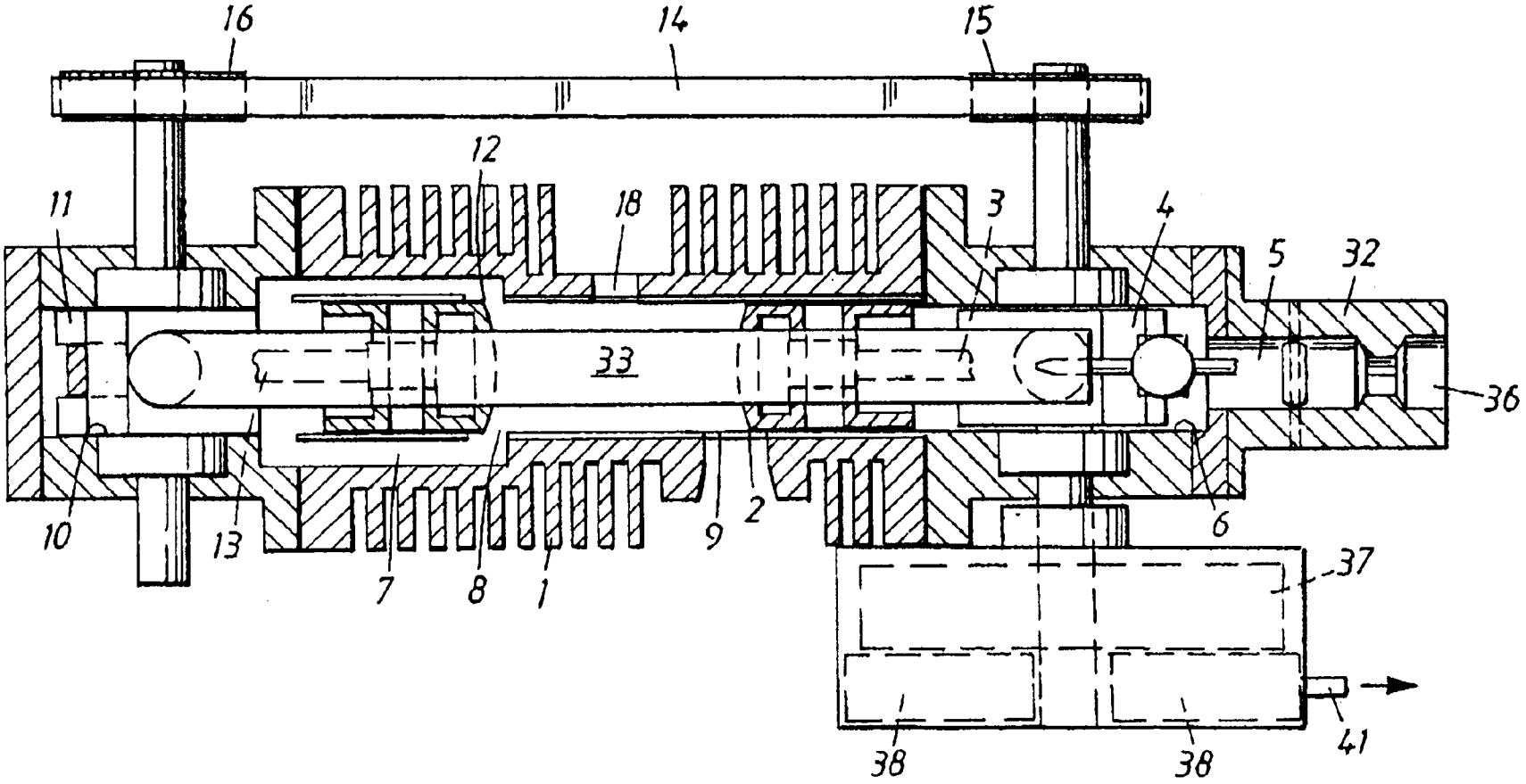
FIG. 1 is a longitudinal section view of an engine constructed in accordance with the invention.
Figure 2:
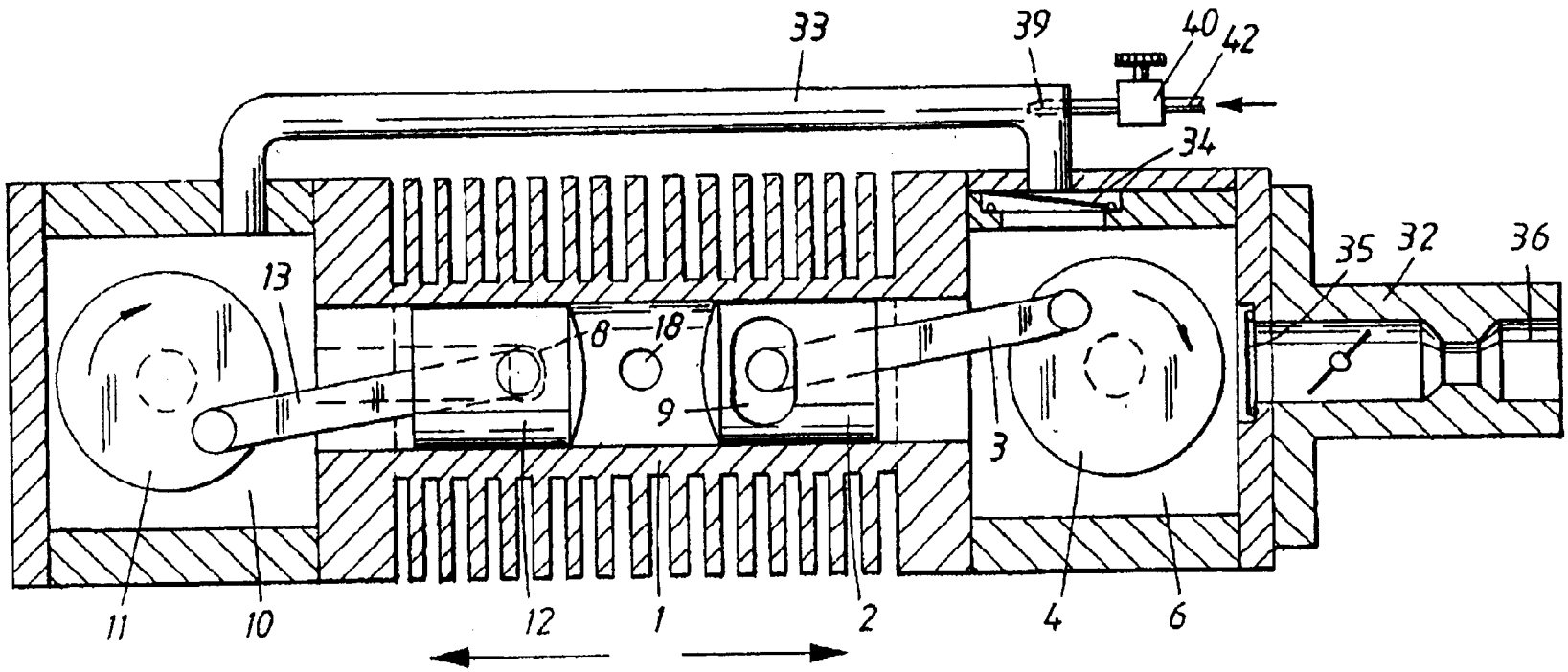
FIG. 2 is a schematic longitudinally sectioned view corresponding to the view of FIG. 1, but turned 90 degrees.

FIGS. 1 and 2 illustrate a two-stroke internal combustion engine that includes a cylinder 1, a piston 2 and a connecting rod 3 connected between a crankshaft 4 and the piston 2. The engine also includes an inlet 5 to a crankcase 6 for the fuel mixture from a conventional carburetor 32. The inlet includes a leaf spring 35 or corresponding valve. Air is delivered via an inlet 36.

The cylinder 1 is common to two pistons 2, 12 that move towards and away from each other. In addition to the crankcase 6, the engine includes a further crankcase 10 at the other end of the cylinder. Each crankcase 6, 10 accommodates crankshafts 4, 11, respectively, which are each connected to pistons 2, 12, respectively, via piston rods 3, 13, respectively. The crankshafts 4, 11 are interconnected so that both pistons 2, 12 will move to their top center positions simultaneously. The pistons will also move simultaneously down to their bottom center positions. In the embodiment shown in FIG. 1, the crankshafts are interconnected by means of a toothed belt 14 with associated belt wheels 15, 16 on each crankshaft. Alternatively, the connection may correspondingly consist of a chain and a sprocket wheel on each crankshaft.

Figures 4A, 4B, 4C, 4D, 4E:
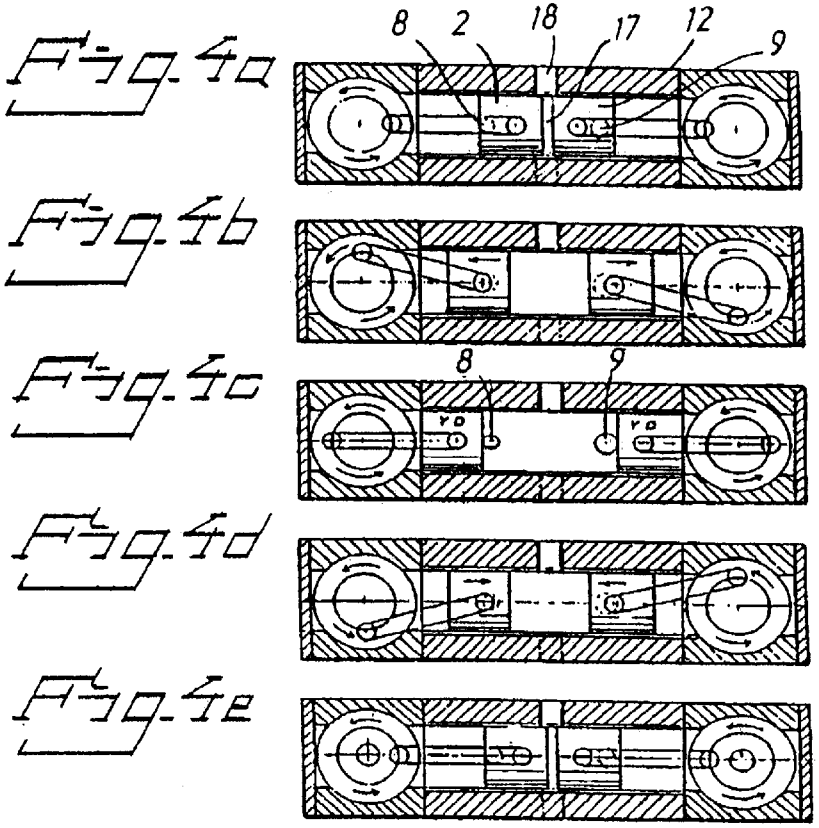
FIGS. 4*a*–4*e* illustrate a working cycle in which the crankshafts of the engine rotate in the same direction.
Figures 3A, 3B, 3C, 3D, 3E:
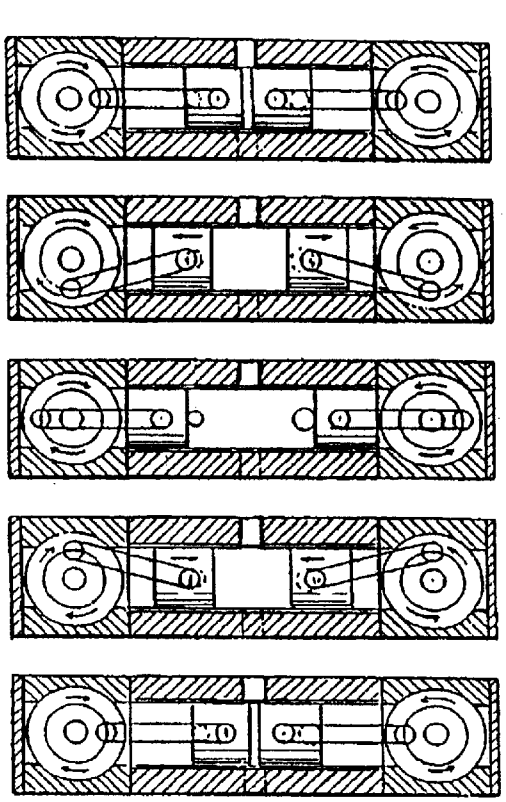
FIGS. 3*a*–3*e* illustrate a working cycle in which the crank-shafts of the engine rotate in opposite directions.

As a result of this arrangement, when the pistons are in their top center positions, their respective upper sides of the pistons will define a combustion chamber 17 together with the cylinder wall, as shown schematically in FIG. 4*a*.

A passageway 7 is located between the crankcase 10 and an induction port 8 in the wall of the cylinder 1. An exhaust port 9 is provided in the cylinder wall. The exhaust port communicates with the surroundings.

The cylinder includes a spark plug hole 18 which is positioned at the location of the combustion chamber defined by the upper surfaces of both pistons and the cylinder wall when the pistons are in their respective top center positions. The hole is adapted to receive a conventional spark plug (not shown). The engine may include two mutually opposing spark plug holes to obtain more positive ignition of the fuel in the combustion chamber defined by the pistons.

FIG. 1 shows a flywheel 37 mounted on the first crankshaft 4. Only the second crankcase is connected to the induction port 8, via a passageway 7, and in which the exhaust port 9 is positioned for cooperation with the piston that belongs to the first crankcase 6. A pipe 33 extends between the first crankcase 6 and the second crankcase 10 for transporting the fuel mixture from the first crankcase to the second crankcase. A check valve 34 is provided between the first crankcase 6 and the inlet end of the pipe 33.

FIG. 4*a*–4*e* illustrate a working cycle of the embodiment of the present invention in which the crankshafts rotate in mutually the same direction. FIG. 4*a* illustrates the top center position at which the fuel is ignited. Upon ignition of the fuel, the pistons are moved away from each other, as shown in FIG. 4*b*, until they reach their respective bottom center position, as shown in FIG. 4*c*. As the first piston 2 moves, it presses out fuel mixture in the pipe 33 through the check valve 34. The fuel mixture in the pipe 33 is thus pressed into the second crankcase 10.

Both the induction port 8 and the exhaust port 9 are exposed in the bottom center position. Fresh fluid mixture then flows from the crankcase 10 through the passageway 7 and into the cylinder through the induction port 8 at the same time as the exhaust gases are caused to flow out of the exhaust port 9 by the in-flowing fuel mixture.

The pistons then move towards one another, as shown in FIG. 4*d*, under the influence of a flywheel 20, 21, 37 on one or both of said crankshafts until the top center position is again reached, as shown in FIG. 4*e*. The cycle may then be repeated. No reference numerals or signs have been included in FIGS. 4*b*–4*e* for improved clarity.

The engine design of the present invention has been found to generate extremely low emissions of CO and HC. The reasons why these low emissions are achieved is not fully understood, but is thought to be the result of several mutually co-acting factors. One factor is that the first crankcase presses the fuel mixture out into the pipe once with each revolution at the same time as the check valve 34 prevents the generation of a sub-pressure in the pipe 33 as the first piston moves towards its top center position. This means that as the second piston moves towards its top center position, it will be supplied with fuel mixture of higher pressure than would be the case if the check valve was not present. It is assumed that this higher pressure results in a more effective purging or flushing of the cylinder as the second piston moves its bottom center position and both the induction port 8 and the exhaust port 9 are opened in conjunction therewith.

Another contributing factor is that because the fuel mixture produced in the carburetor 36 flows through the pipe 33 in addition to flowing through the first crankcase, the second crankcase will receive a highly homogenous fuel/air mixture.

According to one preferred embodiment of the present invention, an air supply passage 39 extends along the length of the pipe 33 and functions to deliver air at atmospheric pressure to the fuel mixture in the pipe 33. The air supply passage 39 will conveniently include a valve 40 for regulating the air pressure.

According to a further embodiment of the present invention, the engine includes a compressor 38, or an impeller, which functions to generate the compressed air and which is driven by the engine. The compressor 38 is suitably mounted adjacent to the flywheel of the engine. An outlet passage 41 extending from the compressor is connected to an inlet passage 42 of the valve 40.

It has been found that emissions are markedly reduced when compressed air is delivered to the pipe 33 containing the gas mixture. It is thought the reason for this is the same as that explained above, namely that the purging or flushing of the cylinder is improved.

According to yet another preferred embodiment of the present invention, the induction port 8, or inductions ports, is/are positioned so as to be fully open when the first piston 2 of the first crankcase 6 is closed or is at its bottom center position.

According to still yet another preferred embodiment of the present invention, the exhaust port 9, or exhaust ports, is/are positioned so as to be fully open when the second piston 12 of the second crankcase 10 is closed or in its bottom center position. Because the crankshafts are interconnected, a flywheel 37 may be mounted on only one of the crankshafts 4, in accordance with a further embodiment of the present invention. In another embodiment, one of the crankshafts may form a drive shaft.

Figure 5:
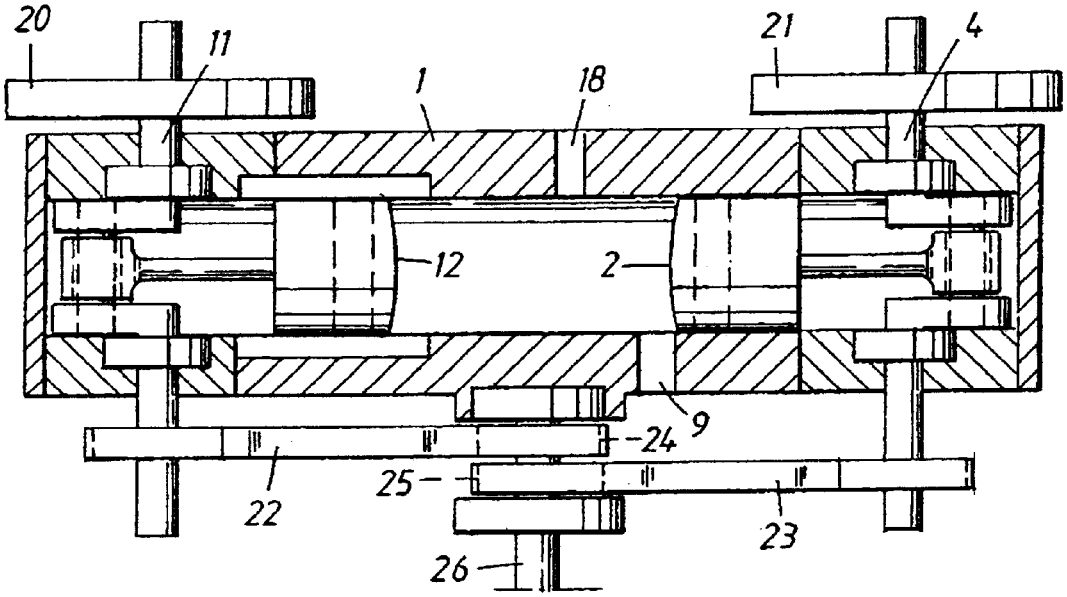
FIG. 5 is a schematic sectioned view corresponding to the sectional shown in FIG. 1 but with an alternative connection disposed between the crankshafts.

FIG. 5 illustrates an alternative embodiment of the present invention with respect to the connection between the crankshafts. This embodiment includes two cog belts 22, 23 which each coacts with a crankshaft and a belt wheel 24, 25 which is fixed to an output drive gear 26. The crankshafts rotate in mutually the same direction.

Figure 6:
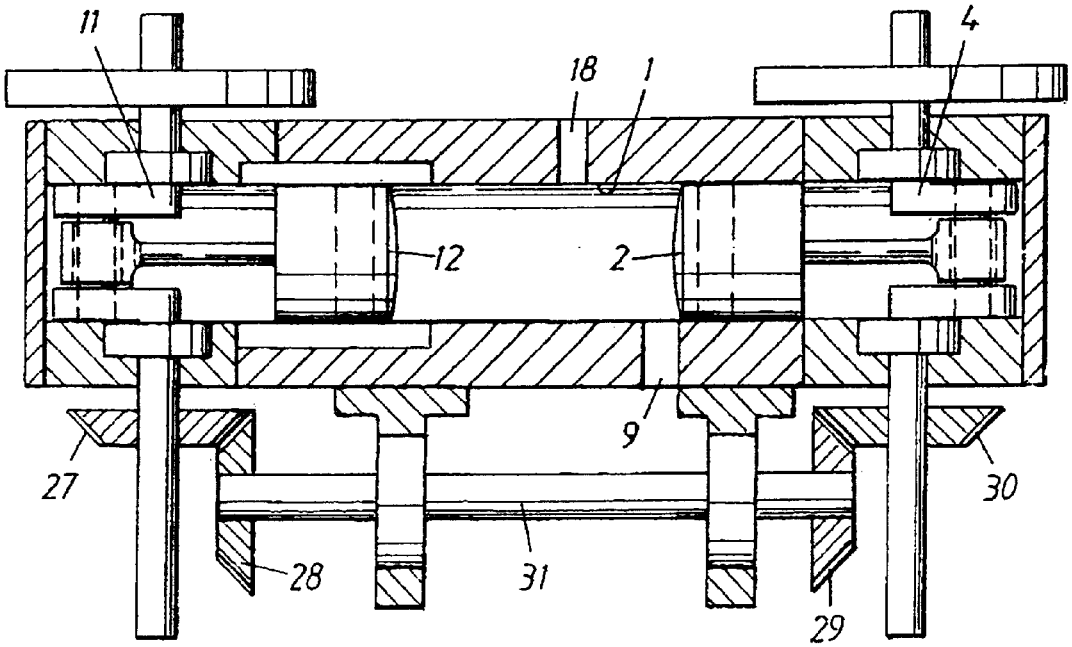
FIG. 6 is a schematic sectioned view corresponding to the sectional shown in FIG. 1 but with another alternative connection between the crankshafts.

FIG. 6 shows another embodiment of the present invention with respect to the connection of the crankshafts. The crankshafts are connected mechanically by means of cog wheels 27, 28 and cog wheels 29, 30 and a common shaft 31 extending between the cog wheels 28, 29. The cog wheels are bevelled and the crankshafts rotate in mutually opposite directions.

Depending on design, it is conceivable to provide a cog wheel on each crankshaft and for the cogs to be in immediate engagement with each other. The crankshafts will also rotate in opposite directions in this case.

FIGS. 3*a*–3*e* illustrate a cycle that corresponds to the cycle illustrated in FIGS. 4*a*–4*e*, but with the sole difference that the crankshafts rotate in mutually opposite directions. These figures have not been provided with reference numbers or signs for improved simplicity.

The distance between induction port and exhaust port is very long in comparison with conventional two-stroke engines, and there is delivered to the cylinder a homogenous fuel mixture at a pressure that is higher than that used with conventional two-stroke engines. This results in very low emissions of non-combusted fuel mixture and of CO and HC, or completely eliminates such emissions. This means, in turn, that a two-stroke engine can be made to achieve essentially complete combustion, by the person skilled in this art making typical optimization with respect to the design of the inductions port(s) and exhaust port(s), the shape of the upper side of the piston, spark plug positions, the optional addition of compressed air, etc.

In addition, the construction of the two-stroke engine of the present invention is more simple than that of conventional two-stroke engines that includes two cylinders. Furthermore, the engine of the present invention is balanced-out due to movements of the pistons towards and away from each other.

Both crankcase will be lubricated because the fuel mixture containing two-stroke oil will flow in through the first crankcase 6 from the carburetor and from there to the second crankcase 10, via the pipe, and then into the cylinder.

Although the present invention has been described above with reference to a number of schematically illustrated drawings, it will be understood that the person skilled in this art will be able to make many modifications without departing from the spirit of the invention.

The invention shall not therefore be considered restricted to the above described exemplifying embodiments, since variations can be made within the scope of the following claims.

What is claimed is:

1. A two-stroke internal combustion engine comprising:

a cylinder having a cylinder wall and a first end and an opposite second end;

a first piston and a second piston disposed in the cylinder, the first piston and second position being movable away and towards one another;

the cylinder having an inlet defined therein;

the cylinder having a first crank-case for mixing fuel from a carburetor, the first crank-case being at the first end of the cylinder and a second crank-case at the second end of the cylinder, the carburetor being in operative engagement with the first crank-case;

the cylinder wall having an induction port and an exhaust port defined therein;

the cylinder having a passage defined therein, the passage extending from the induction port to the second crank-case;

the first crankshaft being disposed in the first crank-case, the first crankshaft being connected to the first piston via a first piston rod;

a second crankshaft being disposed in the second crank-case, the second crankshaft being connected to the second piston via a second piston rod, the first crankshaft being interconnected with the second crankshaft so that both the first and the second pistons are simultaneously movable towards a bottom center position and towards a top center position;

the second crank-case being in fluid communication with the induction port via the passage;

the exhaust port being positioned to cooperate with the first piston of the first crank-case;

a pipe extending between the first crank-case and the second crank-case for providing a supply of a fuel mixture from the first crank-case to the second crank-case, the supply of the fuel mixture from the first crank-case to the second crank-case being limited to only via the pipe; and a check valve disposed between the first crank-case and an inlet end of the pipe.

2. The two-stroke internal combustion engine according to claim 1 wherein the pipe has a supply air passage defined therein that extends along a length of the pipe for supplying a compressed air to the fuel mixture at a pressure that is above an atmospheric pressure.

3. The two-stroke internal combustion engine according to claim 2 wherein the compressed air is adapted to supply a predetermined pressure.

4. The two-stroke internal combustion engine according to claim 2 wherein the combustion engine further comprises a compressor for generating the compressed air, the compressor is driven by the two-stroke combustion engine.

5. The two-stroke internal combustion engine according to claim 1 wherein the induction port is positioned to be fully opened when the second piston of the second crank-case is adjacent to the bottom center position.

6. The two-stroke internal combustion engine according to claim 1 wherein the exhaust port is positioned to be fully opened when the first piston of the first crank-case is adjacent to the bottom center position.

7. The two-stroke internal combustion engine according to claim 1 wherein the first crankshaft is connected to the second crankshaft with a cog belt.

8. The two-stroke internal combustion engine according to claim 1 wherein the first crankshaft is connected to the second crankshaft with cog wheels.

9. The two-stroke internal combustion engine according to claim 1 wherein the first crankshaft is connected to the second crankshaft with a connection shaft.

* * * * *